US006748843B1

(12) United States Patent
Barker et al.

(10) Patent No.: US 6,748,843 B1
(45) Date of Patent: Jun. 15, 2004

(54) UNIQUE PHASINGS AND FIRING SEQUENCES FOR PERFORATING GUNS

(75) Inventors: James Barker, Mansfield, TX (US); Jerry Walker, Fort Worth, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/342,482

(22) Filed: Jun. 26, 1999

(51) Int. Cl.[7] ..... E21B 43/119

(52) U.S. Cl. ..... 89/1.15; 177/4.55

(58) Field of Search ..... 89/1.15; 175/4.6, 175/4.55

(56) References Cited

U.S. PATENT DOCUMENTS 4,552,234 A * 11/1985 Revett ..... 166/297
4,960,171 A * 10/1990 Parrott et al. ..... 175/4.55
5,323,684 A * 6/1994 Umphries ..... 89/1.15
5,542,480 A * 8/1996 Owen et al. ..... 175/4.51
5,638,901 A * 6/1997 Shirley et al. ..... 166/55.1
5,701,964 A 12/1997 Walker et al.

* cited by examiner

*Primary Examiner*—Stephen M. Johnson
(74) *Attorney, Agent, or Firm*—Paul I. Herman, Esq.; David W. Carstens

(57) ABSTRACT

A unique phasing pattern is provided that maximizes the effective perforation geometry of a wellbore. The improvement overcomes the problems associated with multi-phase guns of the past that failed to account for the fact that the gun rested on the low side of the casing. In one embodiment of the present invention, the phasing is arranged so that there is a zero phase tunnel formed. The zero phase tunnel is located at approximately the location where the gun rests against the low side of the well. Further, tunnels are formed by shape charges at plus and minus forty-five degrees and at plus and minus ninety degrees. This can also be referred to as a penta-phase. In another embodiment of the invention, charges can also be placed to allow for a plus and minus one hundred and thirty-five degrees pattern in addition to the penta-phase pattern described above. This expanded pattern can also be referred to as a hepta-phase pattern. By improving the phasing pattern of the perforation gun, valuable hydrocarbon fluids will encounter less resistance to flow into the well.

1 Claim, 5 Drawing Sheets

UNIQUE PHASINGS AND FIRING SEQUENCES FOR PERFORATING GUNS

BACKGROUND OF THE INVENTION

1. Technical Field of the Invention

This invention relates to an improved perforation gun assembly and its unique phasing of the explosive shape charges to maximize production of oil and/or gas.

2. Description of Related Art

During the completion of a well, it is common to perforate the hydrocarbon containing formation with explosive charges to allow inflow of hydrocarbons to the wellbore. These charges are loaded in a perforation gun and are typically shaped charges that produce an explosive formed penetrating jet in a chosen direction. The effectiveness of the "perforation" is governed by many factors including, but not limited to, the orientation of the gun, the linear spacing and angular arrangement of the explosive charges, the properties of the formation, and the well casing geometry.

Conventional perforating guns come in two primary styles: hollow carrier guns and carrier strip guns. FIG. 1 illustrates a typical hollow carrier gun 10. A plurality of charges 12 are connected to each other by a detonation cord 14. The charges are spaced from each other by a strip 16. Common spacing for such guns is four to six charges 12 per foot. The explosive charges are protected from fluid in the well bore by a housing 18. The housing can be scalloped 20 to enhance charge performance and facilitate gun retrieval. FIG. 2 illustrates a capsule gun carrier strip assembly 24. Carrier strip assembly 24 includes first and second strip members 26 and 28. Strip members 26 and 28 are each elongated members having provisions for retaining shaped charges 30 thereto. Coupling the strip member 26 and 28 together, is a coupling plate 32. A detonation cord 25 connects each of the charges to a detonation energy source. In both figures, the charges are aligned in the same phase. This will produce a single phase of perforation in the formation as shown in FIG. 3.

Referring to FIG. 3, casing 2 is cemented in the well bore 6 by cement 4. During the creation of the well bore, the drilling process can damage a zone around the well. This zone can vary in diameter, but is generally shown by line 8. In this damaged zone, the permneabilty of the formation is particularly diminished. The perforation zone 9 should extend through the casing 2, the cement 4 and through the damaged zone 8 and into the formation 7. When all of the charges are aligned in the same phase, a single perforation phase 9 is formed. This is also called a zero phase perforation. It is well known that while a single phase allows fluid flow into the completed well, it is an incomplete solution. Fluid on the other side of the well from the zone 9 can have difficulty migrating through or around the damaged area and into the zone 9.

One solution is to stagger the shape charges at plus forty-five degrees and minus forty-five degrees from the original zone. FIG. 4 and FIG. 5 illustrate this configuration and the resulting "tri-phase" pattern it produces. The charges are evenly spaced along the carrier strip 52. A first charge 54 is provided with a positive forty-five degree offset. The second charge 56 is provided with no angular offset. The third charge 58 is provided with a minus forty-five degree offset. The fourth charge 60 is provided with no offset, and the final charge illustrated 62 is given a positive forty-five degree angular offset. The tri-phase gun 50 will produce three distinct phases of perforation tunnels 66, 68, and 70.

Each tunnel should penetrate through the casing 2, cement 4, and the damage zone 8. A tri-phase pattern helps improve the formation's inflow performance more than a zero phase pattern. Note that the gun 50 is located against one portion of the casing 2 rather than being suspended in the middle. This is true in the field because no well is perfectly vertical. When the gun is suspended into the well, gravity will naturally pull the gun against the low side of the casing.

When considering the phasing and order of angular offset with a tri-phase gun, one design consideration involves the effect of the detonation of the first charge with subsequent charges. In other words, when the first charge 54 detonates, the shock wave from that charge can physically damage or interrupt the second charge 56 as it detonates. The burn rate of the detonation cord 64 is particularly important. While cords burn at extremely fast rates, as the cord lengthens between charges, the more time will pass before the next charges detonates. For a given linear interval between charges, the cord between a charge located at plus forty-five degrees to a charge at zero offset is shorter than a cord between a charge at plus forty-five degrees and a charge at minus forty-five degrees. This is easily understood with reference to FIG. 4. Thus, it is preferable to minimize the cord length between adjacent charges. The order of detonation also is implicated. For example, the gun shown in FIG. 4 detonates charges in a sequence that maintains the shortest fuse length between charges: +45, 0, −45, 0, +45, 0 and so forth.

Another attempt at improving formation production involves the use of a six phase pattern also known as a sixty degree spiral phase pattern. A gun 80 is loaded with charges, each charge located a sixty degree offset from the previous charge. It will produce a spiral pattern similar to the one shown in FIG. 6. Unfortunately, one result that has been observed is that perhaps only three of the phases will perforate the formation all the way past the damage zone 8. As shown, perhaps only tunnels 82, 84, and 86 penetrate through the damage zone, while tunnels 88, 90, and 92 do not. This is caused by the fact that the gun will rest on the low side of the casing 2. The end result is that if the gun had six charges per foot, only three of the charges per foot had any meaningful impact on the formation. This results in a waste of explosive and a failure to achieve the optimum formation characteristics. Further, larger explosive charges may not be useable because of the limited outer diameter requirements of the gun.

A need exists for an improved method of and assembly for perforating a formation to achieve optimal inflow characteristics by producing novel and nonobvious phasing of the perforations. Such an assembly should minimize the risk of detonation interference from an adjacent charge. Such an assembly should also allow for the maximum number of charges per foot. Finally, the assembly should be able to produce the optimal results without any increase in the outer diameter of the assembly.

SUMMARY OF THE INVENTION

The present invention relates to an improved phasing of charges in a perforation gun as well as the improved gun that implements that phasing. The improvement overcomes the problems associated with multi-phase guns of the past that failed to account for the fact that the gun rested on the low side of the casing. In one embodiment of the present invention, the phasing is arranged so that there is a zero phase tunnel formed. The zero phase tunnel is located at approximately the location where the gun rests against the low side of the well. Further, tunnels are formed by shape charges at plus and minus forty-five degrees and at plus and minus ninety degrees. This can also be referred to as a penta-phase.

In another embodiment of the invention, charges can also be placed to allow for a plus and minus one hundred and thirty-five degrees pattern in addition to the penta-phase pattern described above. This expanded pattern can also be referred to as a hepta-phase pattern. By improving the phasing pattern of the perforation gun, valuable hydrocarbon fluids will encounter less resistance to flow into the well.

Another aspect of the present invention also relates to an oscillating order of detonation of the charges. The present invention minimizes the risk of interference from a previous detonation by minimizing the angular offset between adjacent charges. In other words, each charge in a sequence of charges is separated by a particular angular offset. The offset between adjacent charges is equal to a single multiple of that offset, rather than multiples of that offset. Thus, a penetration pattern is formed which oscillates between the two outer phase penetration tunnels allowing a greater concentration of penetration tunnels per linear spacing on the low side of the well casing and a corresponding increase in production fluids when present.

BRIEF DESCRIPTION OF THE DRAWINGS

The accompanying drawings are incorporated into and form a part of the specification to provide illustrative examples of the present invention. These drawings together with the description serve to explain the principles of the invention. The drawings are only for purposes of illustrating preferred and alternate embodiments of how the invention can be made and used and are not to be construed as limiting the invention to only the illustrated and described examples. Various advantages and features of the present invention will be apparent from a consideration of the accompanying drawings in which.

DETAILED DESCRIPTION OF THE DRAWINGS

Figure 1:
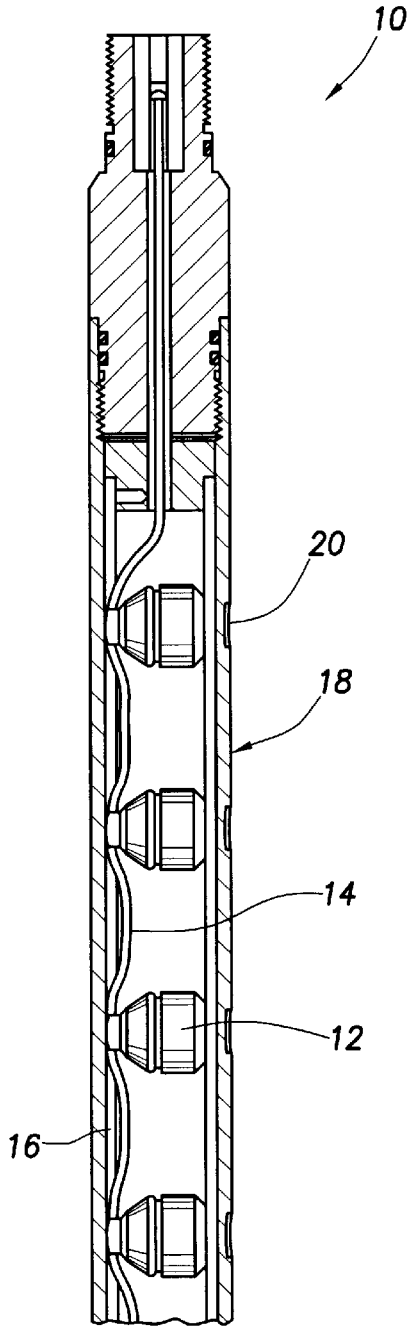
FIG. 1 depicts a prior art hollow casing gun.
Figure 2:
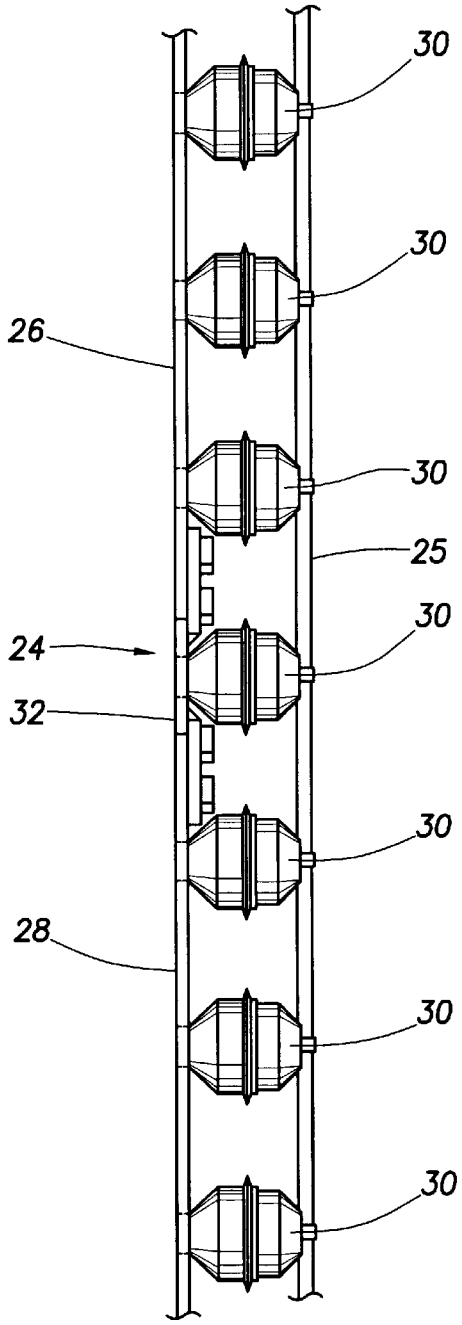
FIG. 2 depicts a prior art carrier strip assembly.
Figure 4:
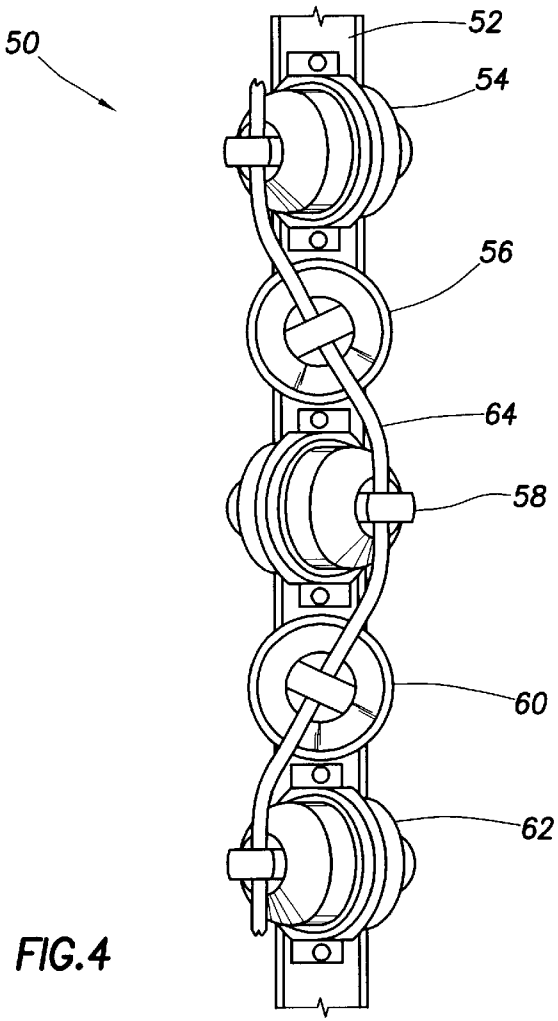
FIG. 4 illustrates a carrier strip loaded for a tri-phase perforation.
Figure 3:
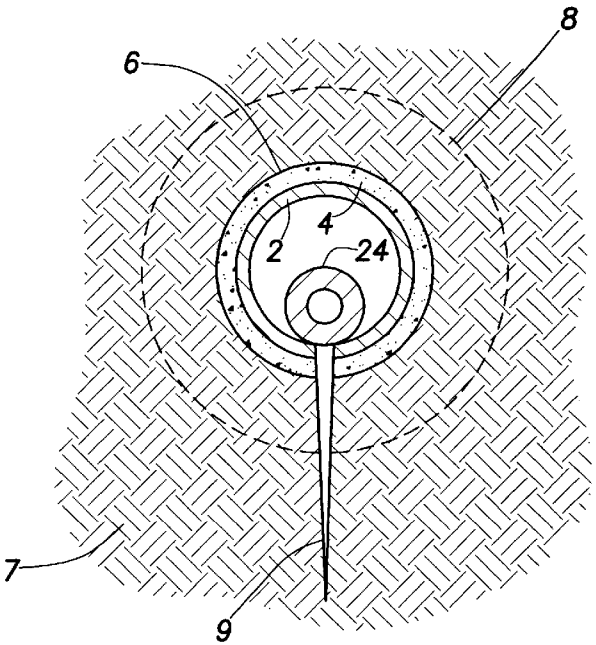
FIG. 3 illustrates a "zero phase" perforation pattern that would be produced by aligned charges on either a hollow casing gun or a carrier strip gun.
Figure 6:
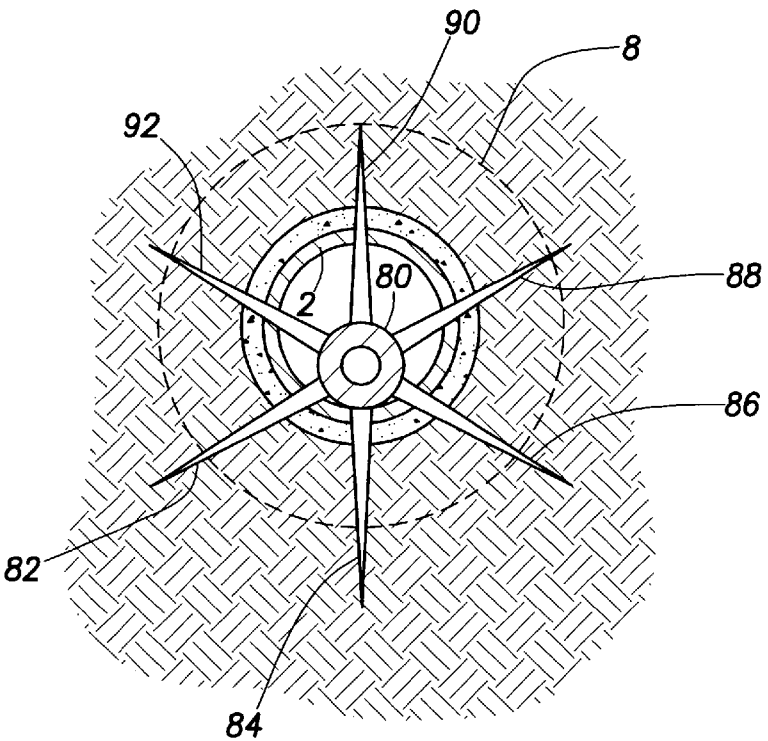
FIG.6 (PRIOR ART)
FIG. 6 is a typical spiral phase perforation pattern illustrating a draw back in this phasing pattern.
Figure 5:
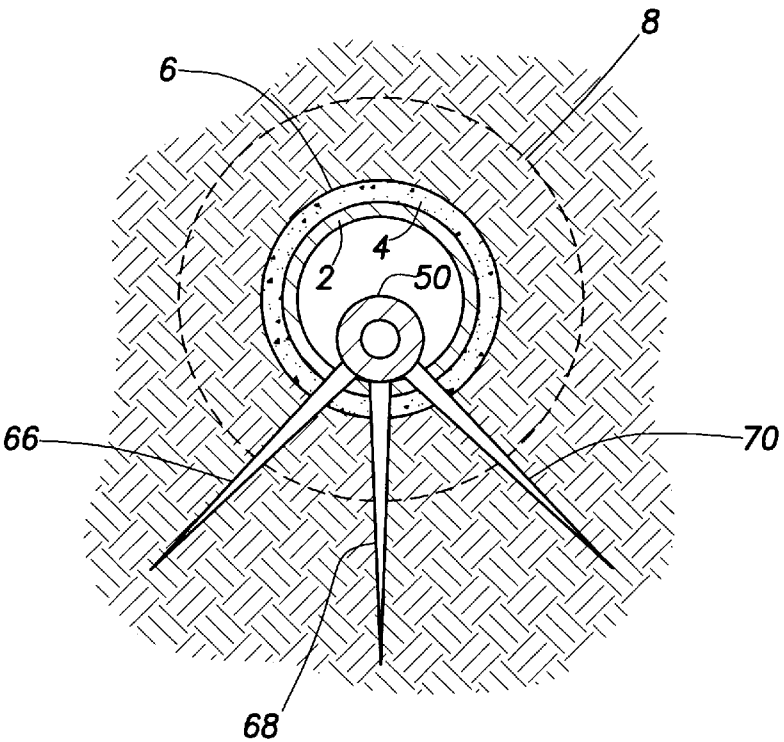
FIG.5 (PRIOR ART)
FIG. 5 illustrates a "tri-phase" perforation pattern that would be produced by charges loaded as shown in FIG. 4.
Figure 7B:
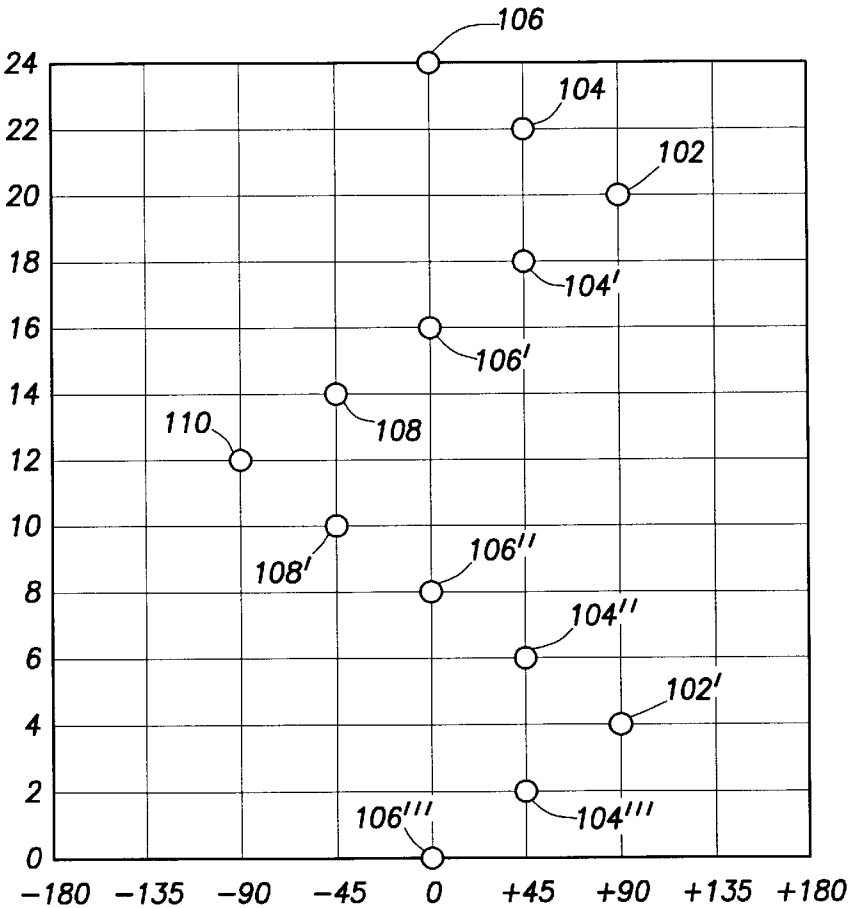
FIG. 7*b* is a phase diagram showing the phase relationship of the first oscillating phasing pattern produced in accordance with the present invention.
Figure 7A:
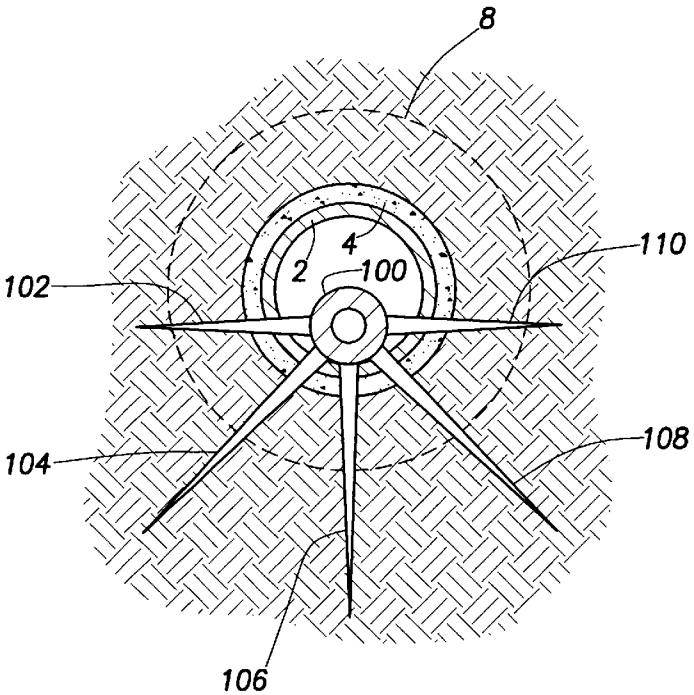
FIG. 7*a* illustrates a first oscillating phasing pattern produced in accordance with the present invention.

The present invention involves an improved perforation gun and the unique oscillating phasing it incorporates. The invention produces superior perforating results because it recognizes that the guns rest on the low side of the casing in the well. Referring to FIGS. 7*a* and 7*b*, the oscillating perforation pattern produced by a gun 100 embodies the present invention. The gun can be either a hollow carrier gun or a capsule gun as described above. In either case, the oscillating perforation pattern is produced by the angular orientation of the shape charges at plus ninety degrees, plus forty-five degrees, zero degrees, minus forty-five degrees, and minus ninety degrees. These charges will produce five phases of perforation tunnels 102, 104, 106, 108 and 110 respectively.

It is assumed that all charges will be of approximately the same strength and produce a tunnel of approximately the same length into the formation. Again, the goal is to penetrate the casing 2, the cement 4 and beyond the damage zone 8. Locating two additional perforations at plus ninety degrees 102 and minus ninety degrees 110 produces two additional perforation phases than the prior art tri-phase pattern and thus improves fluid flow into the well. The present pattern can also be referred to as a low side oscillating penta-phase pattern. In the embodiment described above, the fractures are offset by forty-five degrees from each other. However, the oscillating pattern can be adjusted to allow for six charges at thirty-degree offsets. Indeed, subject to other limitations, even more fractures could be established at closer intervals. In another embodiment, a first and second tunnel is formed at approximately plus and minus ninety degrees from a zero phase tunnel. Additional tunnels can be spaced between the first and second tunnels and the zero-phase tunnel. While reference is made to specific angular offsets, it should be understood that an allowance of some degrees should be allowed when interpreting the meaning of the values given. For example, a positive offset of approximately ninety degrees would easily include positive offsets of one hundred degrees or eighty degrees as well. The value of ninety is merely an exemplary value.

To achieve this oscillating pattern, a gun would be loaded with charges set at five different angular orientations. In one embodiment, the order of loading would be plus ninety degrees, plus forty-five degrees, zero degrees, minus forty-five degrees, minus ninety degrees, minus forty-five degrees, zero degrees, plus forty-five degrees, and so forth. This oscillating pattern minimizes the length of the detonation cord between adjacent charges and thus minimizes the risk of charge-to-charge interference. Other oscillating patterns could also be employed subject to the limitations discussed above. As shown in FIG. 7*b*, the charges would be detonated in a specific oscillating sequence of +90 102, +45 104', 0 106', −45 108, −90 110, −45 108', 0 106", +45 104" and so forth. This specific oscillating firing sequence helps achieve the highest probability that all charges will detonate without interference from an adjacent charge's detonation.

Figure 8B:
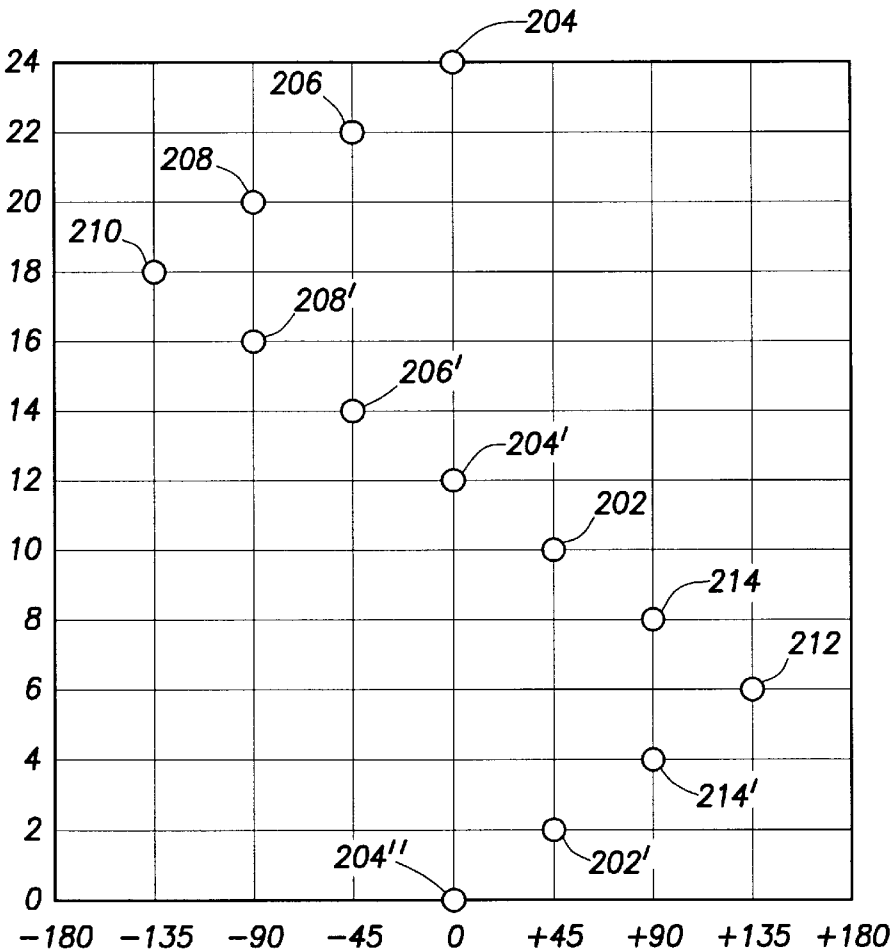
FIG. 8*b* is a phase diagram showing the phase relationship of the second oscillating phasing pattern produced in accordance with the present invention.
Figure 8A:
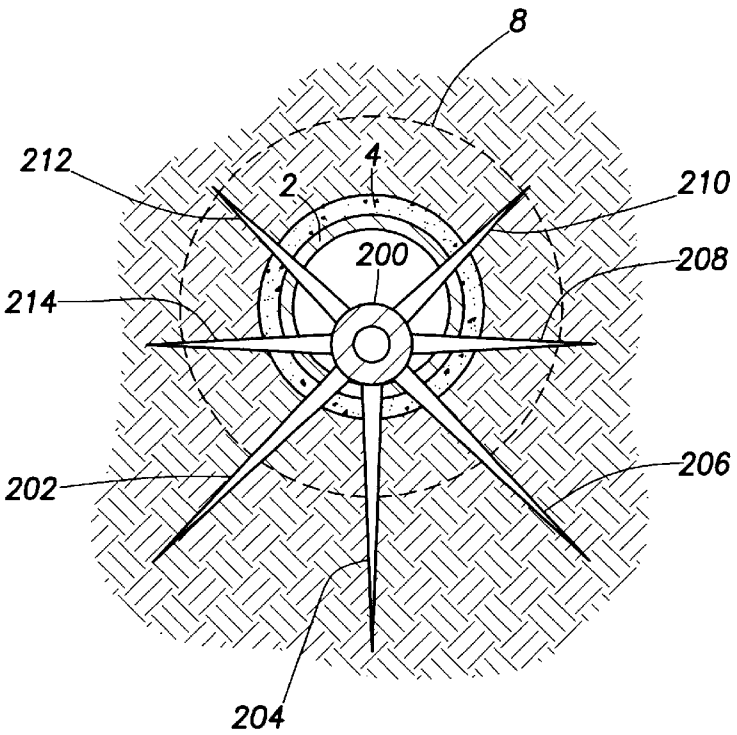
FIG. 8*a* illustrates a second oscillating phasing pattern produced in accordance with the present invention.

Referring to FIGS. 8*a* and 8*b*, a second embodiment of the present invention is illustrated. In this embodiment, two additional perforations are produced at plus one hundred and thirty-five degrees and at minus one hundred and thirty-five degrees. This oscillating pattern can also be referred to as a low-side hepta-phase oscillating pattern. Seven phases of perforations 212, 214, 202, 204, 206, 208, and 210 are offset from each other by forty-five degrees. Based upon the length of the perforation tunnels and the diameter of the damage zone 8, the additional perforations 212, 210 can still produce a useful penetration into the formation and further enhance fluid migration into the well. A gun 200 designed to produce this pattern can load its charges in any of a number of oscillating patterns. In one embodiment, the charges could be loaded at plus one hundred and thirty-five degrees, plus ninety degrees, plus forty-five degrees, zero degrees, minus forty-five degrees, minus ninety degrees, and at minus one hundred and thirty-five degrees. This pattern minimizes the length of the detonation cord between adjacent charges and thus minimizes the risk of charge-to-charge interference. Thus, as shown in FIG. 8*b*, the firing pattern would be −135 210, −90 208', −45 206', 0 204', +45 202, +90 214, +135 212, +90 214', +45 202', 0 204", −45 206", −90 208" and so forth. Other oscillating patterns could also be employed subject to the limitations discussed above.

The embodiments shown and described above are only exemplary. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of parts within the principles of the invention to the full extent indicated by the broad and general meaning of the terms used in the attached claims. It is especially important to note that when angular offsets are provided, the degree of offset is only exemplary. For example, a forty-five degree offset from a zero phase is meant to include any offset that is approximately between thirty and sixty degrees. Each angular offset described, thus, should be given a meaning that includes a substantial variance on either side of the offset.

We claim:

1. A method of firing a perforation gun comprising the steps of:

(a) initiating a detontation cord that interconnects a plurality of charges loaded on a carrier; wherein said charges have an angular offset from a zero plane;

(b) detonating said charges in a sequential order based on the angular offset of said charge, wherein the sequence of angular offsets is +90, +45, 0, −45, −90, −45, and 0 degrees.

* * * * *